US005238612A

United States Patent [19]

Halm et al.

[11] Patent Number: 5,238,612

[45] Date of Patent: Aug. 24, 1993

[54] FILLINGS AND OTHER ASPECTS OF FIBERS

[75] Inventors: Walter B. Halm, Lippetal, Fed. Rep. of Germany; William J. Jones, Jr., Greenville, N.C.; James F. Kirkbride, Wilmington, Del.; Ilan Marcus, Versoix, Switzerland; Adrian C. Snyder, Greenville, N.C.

[73] Assignee: E. I. Du Pont de Nemours and Company, Wilmington, Del.

[21] Appl. No.: 820,141

[22] Filed: Jan. 13, 1992

Related U.S. Application Data

[60] Division of Ser. No. 589,960, Sep. 28, 1990, Pat. No. 5,112,684, which is a continuation-in-part of Ser. No. 508,878, Apr. 12, 1990, abandoned, Ser. No. 549,818, Jul. 9, 1990, abandoned, and Ser. No. 549,847, Jul. 9, 1990, abandoned, each is a continuation-in-part of Ser. No. 290,385, Dec. 27, 1988, Pat. No. 4,940,502, which is a continuation-in-part of Ser. No. 921,644, Oct. 21, 1986, Pat. No. 4,794,038, which is a continuation-in-part of Ser. No. 734,423, May 15, 1985, Pat. No. 4,618,531.

[51] Int. Cl.[5] ..... B22D 11/01

[52] U.S. Cl. ..... 264/15; 264/117; 264/122; 428/357

[58] Field of Search ..... 5/448; 264/1.4, 15, 264/117, 121, 503, 517, 162, 115, 126; 428/288, 290, 296, 297, 369, 370, 357, 373, 391, 375, 395, 85

[56] References Cited

U.S. PATENT DOCUMENTS

| | | | |
|---|---|---|---|
| 3,271,189 | 9/1966 | Hofmann | 428/369 |
| 4,129,675 | 12/1978 | Scott | 428/369 X |
| 4,189,338 | 2/1980 | Ejima et al. | 264/168 X |
| 4,364,996 | 12/1982 | Sugiyama | 428/369 |
| 4,413,030 | 11/1983 | Tesch et al. | 428/85 |
| 4,418,116 | 11/1983 | Scott | 428/369 X |
| 4,469,540 | 9/1984 | Furukawa et al. | 264/171 X |
| 4,477,515 | 10/1984 | Masuda et al. | 428/294 X |
| 4,583,266 | 4/1986 | Tango et al. | 19/0.39 |
| 4,618,531 | 5/1986 | Marcus | 428/283 |
| 4,783,364 | 10/1986 | Marcus | 428/288 |
| 4,794,038 | 10/1986 | Marcus | 428/288 |
| 4,808,202 | 2/1989 | Nishikawa et al. | 428/299 X |
| 4,812,283 | 3/1989 | Farley et al. | 264/122 X |
| 4,818,599 | 4/1989 | Marcus | 428/288 |
| 4,837,067 | 6/1989 | Corey, Jr. et al. | 428/286 X |
| 4,908,263 | 3/1990 | Reed et al. | 428/287 X |
| 4,940,502 | 12/1990 | Marcus | 428/288 |

*Primary Examiner*—Joseph L. Schofer
*Assistant Examiner*—Jeffrey T. Smith

[57] ABSTRACT

Fiberballs are prepared from mechanically-crimped fibers having both a primary crimp and a secondary crimp with specific configurations, especially amplitudes and frequencies. The fiberballs may contain a proportion of other fibers, particularly binder fibers.

10 Claims, 5 Drawing Sheets

FILLINGS AND OTHER ASPECTS OF FIBERS

CROSS REFERENCE TO RELATED APPLICATION

This is a division of application Ser. No. 07/589,960, filed Sep. 28, 1990, now U.S. Pat. No. 5,112,689, which is a continuation-in-part of copending parent application Ser. No. 07/508,878, filed Apr. 12, 1990 now abandoned by Snyder and Vaughn, and Ser. No. 07/549,818 now abandoned and Ser. No. 07/549,847, now abandoned each themselves filed Jul. 9, 1990 by Marcus as continuations-in-part of application Ser. No. 07/290,385, filed Dec. 27, 1988, now issued as U.S. Pat. No. 4,940,502, itself a continuation-in-part of application Ser. No. 06/921,644, filed Oct. 21, 1986, now issued as U.S. Pat. No. 4,794,038, Dec. 27, 1988, itself a continuation-in-part of application Ser. No. 734,423, filed May 15, 1985, now issued as U.S. Pat. No. 4,618,531.

FIELD OF INVENTION

This invention relates to improvements in fiber filling material, especially polyester fiberfill, and more particularly fiberfill which is in a fiberball form, and other aspects and uses of these and other fibers.

BACKGROUND OF THE INVENTION

Polyester fiberfill has become widely used and well accepted as a relatively inexpensive filling material for pillows, quilts, sleeping bags, apparel, furniture cushions, mattresses and similar articles. It has generally been made of polyethylene terephthalate staple (i.e. cut) fibers that have been cut from filaments crimped in a stuffer box-type of crimper. The deniers (or dtex) of the fibers have generally been of the order of 5–6, i.e. a significantly higher denier per filament (dpf) than cotton fibers and polyester textile fibers used in apparel. The fibers may be hollow or solid, and may have a regular round or another cross section, and are cut to various lengths according to the requirements of the end-use or the process.

Polyester fiberfill is often "slickened", i.e. coated with silicones and more recently with polyethylene terephthalate/polyether segmented copolymers, to reduce the fiber/fiber friction. A low fiber/fiber friction improves the hand of the finished article made from the fiberfill, producing a slicker and softer hand, and contributes to reducing a tendency of the fiberfill to mat (or clump together) in the article during use.

Polyester fiberfill staple has generally been processed by being opened and then formed into webs which are cross-lapped to form a wadding (also referred to as a batt) which is used to fill the article. The performance of articles that have been filled using this technique has been satisfactory in many end-uses for many years, but could not fully reproduce the aesthetics of natural fillings such as down and down/feather blends. Such natural fillings have a structure that is fundamentally different from carded polyester fiberfill batts; they are composed of small particles with no continuity of the filling material; this allows the particles to move around within the ticking and to adapt the shape of the article to the user's contours or desires. We believe that the ease with which down and feather fillings can move around plays a key role in their recovery from compression after being compacted, by simple shaking and patting. This virtue is referred to as refluffability.

Contrary to down and feather, the carded polyester fiberfill batts have a layered structure, in which the fibers are parallelised, and are loosely interconnected within each web and between the layers so they cannot be moved around and refluffed in a similar way to down and feather. Polyester fillings have, however, some advantages over natural fillings, particularly in regard to washability and durability. Accordingly, Marcus has developed a fiberfill product composed of small, soft polyester fiber clusters or fiberballs which keep their identity during wear and laundering and enable the user to refluff the article filled with the fiberfill. These clusters combine the good mechanical properties and washability of polyester fiberfill with the refluffability of down or down/feather blends.

Although some particulate products had been produced commercially on modified cards from standard fiberfill, such products were prepared for different enduses, and did not have the properties required for manufacture of high quality bedding or furniture articles. Steinruck disclosed one such modified card and process for making "nubs" in U.S. Pat. No. 2,923,980.

Marcus made his new fiberballs using fibers with specific characteristics as feed for a new fiberball-making process. U.S. Pat. Nos. 4,618,531 and 4,783,364 disclose preferred fiberball products and a process to produce them from spiral crimp (including omega crimp) feed fibers, which can be rolled under mild conditions due to their potential for spontaneous curling. These products have been commercially successful in the U.S. and Europe, mainly in bedding and furniture cushions. Marcus demonstrated that helical crimp was important for achieving the desired fiberball structure, i.e. in providing a desired random arrangement of the fibers within each fiberball, and in achieving a desired low cohesion between the surfaces of neighboring balls. Commercial fibers with standard mechanical crimp did not produce fiberballs having the desired fiberball structure which provides good durability, high filling power and low cohesion, which are key requirements for refluffable filling products.

To optimize the filling power (i.e. to increase the bulk) and durability (i.e. to lower the amount of bulk lost during use), and particularly the durability to laundering, we believe that the fibers within the fiberball should be randomly distributed, should have a uniform density throughout the structure, and should be sufficiently entangled to keep the fiberball identity through laundering or during normal wear. To achieve optimum filling power and durability, we believe that it is important that each fiber within the fiberball should have its bulk fully and individually developed, so that it can fully contribute (to the filling power and to the durability). To achieve this structure, on which depends the performance of the fiberballs, Marcus used fibers which tend to spontaneously curl, so that a good, consolidated structure could be produced under very mild forces. In the aforesaid patents, Marcus disclosed a preferred way to achieve this desired fiberball structure and properties by using fibers with helical crimp as feed fibers and an air tumbling process to roll the fibers under mild forces. The resulting products are characterized by a random distribution of the fibers within the fiberball, by being at least 50% round (having a ratio of the largest dimension to the smallest dimension of less than 2:1) and by having a low cohesion which was not shown in prior products. Marcus did not produce acceptable fiberballs under the same conditions using commercial fibers with standard mechanical crimp.

The feed fibers used by Marcus to make his new fiberballs are relatively unusual, unavailable and/or expensive in some markets, in which by far the majority of polyester staple fiber is crimped mechanically, generally by a stuffer box technique. Ever since Marcus disclosed the value of using fiberfill in the form of a fiberball, rather than as parallelised fibers in a carded batt-type structure, it has been desirable to find out why standard mechanically crimped fibers did not make good fiberballs, and to provide a feed fiber other than what Marcus used. Snyder et al in copending U.S. application Ser. No. 07/508,898 disclosed another process and apparatus for making fiber clusters, and succeeded in processing mechanically crimped feed fiber into satisfactory fiber clusters. An important object of the present application is to provide such mechanically crimped feed fiber that has the capability of being processed into such clusters, sometimes termed fiberballs. Other objects will be apparent herein.

Removable, refluffable cushions are now typical in modern furniture styling. This has created a new need for refluffable fiberfill, so the cushions can be replumped. Furniture also requires filling products having more support and filling power than bedding or apparel. This may require fibers of higher denier. Such fibers may require different crimping conditions from fibers of the order of 5–6 dtex.

In U.S. Pat. No. 4,794,038 to Marcus, there are disclosed fiberballs from spiral crimp fibers and binder fibers which can be molded into a consolidated fiber block. Again, spiral crimped fibers were used to achieve the desired ball structure. It is desirable to provide mechanically-crimped fibers capable of making such fiberballs.

As will be evident herein, the principles of the invention can also be applied to making clusters from fibers other than polyester fiberfill.

SUMMARY OF THE INVENTION

Surprisingly, we have now found that fiberballs with comparable properties can be produced from certain mechanically crimped fibers which have specific crimp configurations. We believe that an important characteristic is a potential to curl spontaneously that is similar in this respect to that of the spiral crimped fibers used as feed fibers by Marcus. Suitable feed fibers have been used with combinations of primary and secondary crimp with specific ranges of frequency and amplitudes. The precise ranges of values required will depend on various considerations, such as the denier and configuration of the feed fiber, and the process technique used to make the balls. The frequency and amplitude of the secondary crimp, especially, and good heat setting of this secondary crimp, are believed to be key requirements for making fiberballs.

According to one aspect of the present invention there are provided refluffable fiberballs having a uniform density, and a random distribution and entanglement of fibers within each ball characterized in that the fiberballs have an average cross-section dimension of about 2 to about 20 mm, and that the individual fibers have a length in the range of about 10 to 100 mm and are prepared from fibers having a primary crimp and a secondary crimp, said primary crimp having an average frequency of about 14 to about 40 crimps per 10 cm and said secondary crimp having an average frequency of about 4 to about 16 crimps per 10 cm, and having an average amplitude from the fiber longitudinal axis of at least 4 times the average amplitude of the primary crimps.

Also provided are fiberballs having a random distribution and entanglement of fibers within each ball, said fibers being a blend of load bearing fibers and binder fibers, which optionally contain a material capable of being heated when subjected to microwaves or a high frequency energy source, characterized in that the fiberballs have an average diameter of from about 2 mm to about 20 mm and the individual fibers have a length of about 10 to about 100 mm, the load-bearing fibers having primary crimp and a secondary crimp, said primary crimp having an average frequency of about 14 to about 40 crimps/10 cm and the said secondary crimp having an average frequency of from about 4 to about 16 crimps/10 cm, and whereby the average amplitude of the secondary crimp is at least 4 times the average amplitude of the primary crimp.

Further provided are processes for making the aforesaid fiberballs as more fully described herein.

Accordingly, one such process according to the invention is a process for preparing fiberballs, wherein mechanically-crimped staple fiber to length about 10 of about 100 mm is prepared having a primary and a secondary crimp, said primary crimp having a frequency of about 14 to about 40 crimps/10 cm and said secondary crimp having a frequency of about 4 to about 16 crimps/10 dm, and whereby the average amplitude of the secondary crimp is at least 4 times the average amplitude of the primary crimp, and wherein tufts of said mechanically-crimped staple fiber are processed by air-tumbling against the wall of a vessel to make fiberballs having a random distribution and entanglement of fibers within each ball and of average diameter about 2 to about 20 mm.

Another such process is a process for preparing fiberballs, wherein staple fiber of length about 10 to about 100 mm is prepared having a primary and a secondary crimp, said primary crimp having a frequency of about 14 to about 40 crimps/10 cm and said secondary crimp having a frequency of about 4 to about 16 crimps/10 cm, and whereby the average amplitude of the secondary crimp is at least 4 times the average amplitude of the primary crimp, and wherein said staple fiber in opened condition is processed through a roller card to make fiberballs having a random distribution and entanglement of fibers within each ball and of average diameter about 2 to about 20 mm.

A further such process for preparing fiberballs, wherein staple fiber of length about 10 to about 100 mm is prepared having a primary and a secondary crimp, said primary crimp having a frequency of about 14 to about 40 crimps/10 cm and said secondary crimp having a frequency of about 4 to about 16 crimps/10 cm, and whereby the average amplitude of the secondary crimp is at least 4 times the average amplitude of the primary crimp, and wherein said staple fiber in opened condition is processed through a flat card to make fiberballs having a random distribution and entanglement of fibers within each ball and of average diameter about 2 to about 20 mm.

Preferred features are wherein polyester staple fibers are processed into fiberballs, preferably of roundness such that at least 50% by weight of the balls have a cross section such that the maximum dimension of each ball is not more than twice the minimum dimension, and wherein the fibers are preferably coated with about 0.05% to about 1.2% (by weight of the fibers) of a slickener which consists essentially of a segmented copolymer of poly(alkyleneoxide) units and of ehtylene terephthalate units, and/or wherein the fibers are preferably coated with a slickener, which is a silicone polymer, is amount about 0.01% to about 1% Si (by weight of the fibers).

Other preferred features are wherein a blend of said staple fibers with binder fibers is processed to make fiberballs, said binder fibers optionally containing an electromagnetic radiation susceptor, i.e., a material capable of being heated when subjected to microwaves or a high frequency energy source preferably wherein the binder fibers are polymeric bicomponent sheath-/core or polymeric bicomponent side-by-side fibers, consisting essentially of a component polymer with a bonding temperature that is at least 5020 C. below the melting temperature of another component polymer, and wherein the fiberballs are preferably molded into a molded structure by activating binder in said binder fibers so as to bond the staple fibers and form a bonded structure, in which the staple fibers becomes load-bearing fibers.

Additionally provided are molded structures prepared from fiberballs which contain binder fibers.

Other aspects of the invention are preferred feed fibers for making the fiberballs, and processes involved in making suitable feed fibers.

According to such other aspects of the invention, processes are provided for mechanically crimping a tow band of polyester filaments of lower denier (about 4 to about 10 dtex) per filament in a stuffer box crimper at a crimper loading of about 13 to about 26 ktex per inch of crimper width, and for heat-setting the crimped tow band to provide crimped filaments having a primary crimp with an average frequency of about 14 to about 40 per 10 cm and a secondary crimp with an average frequency of about 4 to about 16 per 10 cm, and an average amplitude at least 4X the average amplitude of the primary crimp and for converting the resulting crimped tow band into cut fiber to provide feed fiber for a process for making fiberballs from such feed fiber, and for making such fiberballs by an air-tumbling process or by using a ball-making machine equipped with card clothing, e.g. of the modified roller-top type, or as disclosed, e.g., by Snyder et al. in U.S. application Ser. No. 07/508,878, and preferred mechanically-crimped feed fiber for use in such ball-making machines and processes. Similar processes are provided for polyester filaments of higher dtex, with crimper loadings, e.g., up to about 34 ktex per inch, correspondingly. The invention should not be considered limited only to inducing the appropriate crimp by use of a mechanical crimper of the stuffer box-type, for example, but alternative methods of inducing the appropriate structure, are also contemplated.

BRIEF DESCRIPTION OF DRAWINGS

FIGS. IA, IB, 2A, 2B, 3, 4, and 5 are all photographs, the details of which are given hereinafter.

DETAILED DESCRIPTION OF THE INVENTION

Figure 2A:
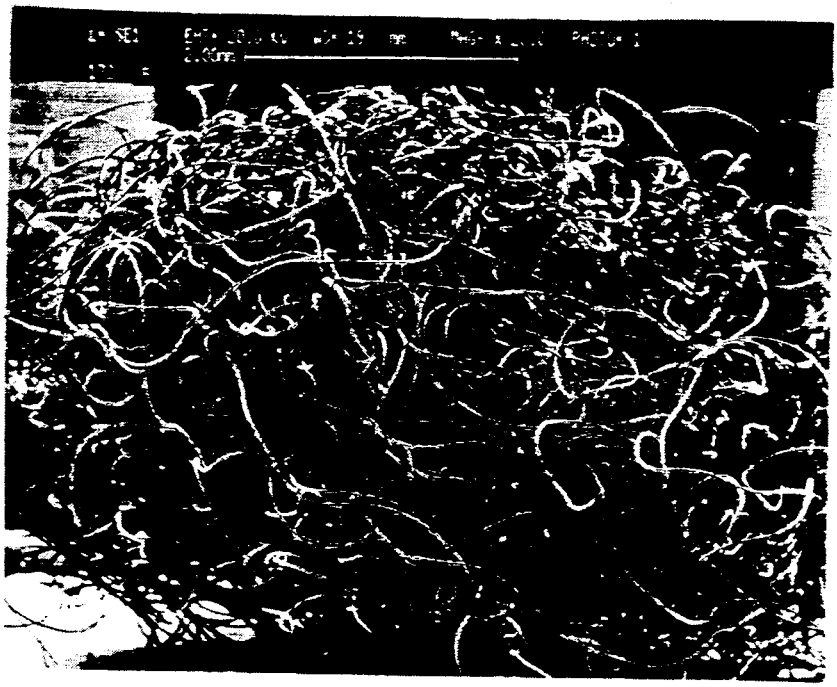
Figure 2B:
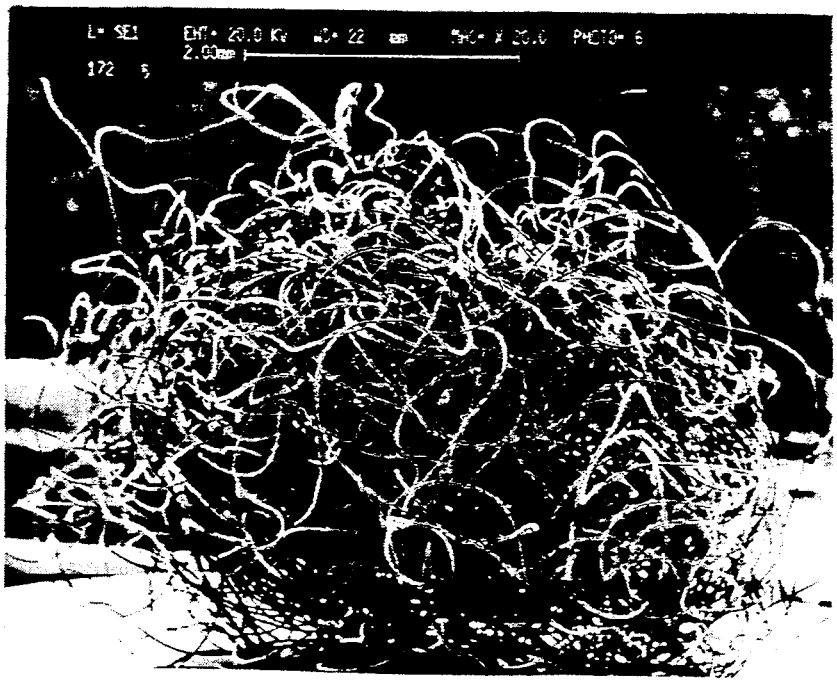

According to the present invention, certain mechanically-crimped feed fibers can produce fiberballs with refluffability and durability characteristics similar to those produced from spiral crimp fibers (sometimes referred to as helical crimped fibers) when submitted to similar process conditions. A broader range of mechanically crimped feed fibers can make satisfactory fiberballs when subjected to other fiberball making processes such as the one described in copending U.S. patent application Ser. No 07/508,878, filed Apr. 12 1990 Now abandoned (DP-4690), by Snyder et al., the disclosure of which is incorporated herein by reference. In some cases, the structure of the fiberball is so similar to the one obtained from spiral crimped fibers that it is difficult to distinguish the two products, even in Electron Scanning Microscope (ESM) photographs of the fiberballs. Reference is made in this regard to FIGS. IA, IB, 2A and 2B, which are all ESM photographs at a magnification of 20X. FIGS. IA and IB are photographs of fiberballs prepared from a mechanically crimped feed fiber as described in Example 1 hereinafter. FIGS. 2A and 2B are photographs of commercial fiberballs prepared from a spirally crimped feed fiber. These are discussed in more detail hereinafter. Generally, the easiest way to examine the crimp of the feed fiber from which any fiberball has been prepared, is to find some of the free ends that usually extend from the fiberballs, and examine the portions extending out of the ball, rather than try to disentangle the fiberballs themselves. It is difficult to provide an adequate 2-dimensional representation of fiberballs such as are illustrated in these Figures, but ESM photographs give a better representation than a photo made with an ordinary camera. These ESM photographs are provided to show the structural similarity to the commercial product that is achievable according to the present invention with mechanically-crimped feed fiber.

Producing fiberballs with a good structure from mechanically crimped fibers is of particular practical and commercial interest for fibers with special cross sections which are difficult to produce and/or crimp with the spiral crimp or bicomponent techniques, such as fibers having multiple channels and/or high void contents and high denier fibers. The technology disclosed herein makes it possible to produce fiberballs with a three dimensional structure, low cohesion, and good durability from practically any source of spun synthetic filaments, by modifying the crimping conditions and so producing a specific combination of primary and secondary crimp as disclosed hereinafter. As will be recognized by those skilled in the art, any crimping operation must be to some extent empirical, as the expert will modify the crimping conditions according to the particular feed fiber, according to the type, dimensions and-/or construction of crimper, and according to what is desired, experimenting until the results (in fiberballs, in the present instance) are satisfactory, but guidelines are given herein.

For filling purposes, fiberballs should preferably be round and have an average diameter of 2–20 mm, at least 50% by weight of the balls preferably having a cross section such that the maximum dimension is not more than twice the minimum dimension. The fiberballs are made up of randomly arranged, entangled, fibers that have been heat set to provide both a primary and a secondary crimp with specific frequency and amplitudes. A suitable primary crimp has an average frequency of about 14 to about 40 crimps per 10 cm, preferably about 18 to about 28 (or for some fibers to about 32) crimps/10 cm, with a suitable secondary crimp having an average frequency about 4 to about 16 per 10 cm and an average amplitude of the secondary crimp that is at least 4× the amplitude of the primary crimp. The crimped polyester fibers have a cut length of about 20 mm to about 100 mm and a linear density (for fiberfill purposes) of about 3 to about 30 dtex. Lower dtex levels will not generally provide good resilience or filling support, but lower dtex polyester or other fibers may be processed into fiberballs for other purposes, e.g. for use as nubs in novelty yarns, if desired. Indeed, it will be understood that the ranges referred to herein are approximate, and that precise limits for any fiber will generally depend on various factors, such as desired end use, other fiber factors, such as denier and cross-sectional configuration, and the process conditions specifically selected for that particular fiber.

According to specific end-uses, the fiberballs may contain a proportion, generally up to 30%, of other fibers, particularly binder fibers. As will be evident to those skilled in the art, now that we have discovered how to make mechanically crimped fiber suitable for conversion into fiberballs, as well as converting spirally crimped fiber (as taught by Marcus), it is possible to make fiberballs from various blends of fibers, particularly blends of spirally crimped fibers and of mechanically-crimped fibers that are suitable for making fiberballs. Again, the precise proportions and crimp configurations of such fibers needed in such blends will depend on factors such as the technique to be used to make fiberballs, and the denier and cross-section of the fibers and, additionally for blends, the other constituents of the blend. The load-bearing fibers can be coated with a slickener such as a silicone slickener or a segmented copolymer consisting essentially of polyoxyalkylene and polyethylene terephthalate to reduce fiber/fiber friction. Besides the improved softness in the end-use product, the lubrication also plays an important role in the fiberball making process by helping the fibers to slide one on top of the other during the process, reducing the force required to roll them.

In order to understand the crimp configurations of the feed fibers of the invention and how to obtain such crimp configurations, some general discussion of crimping may be helpful.

Figure 6:
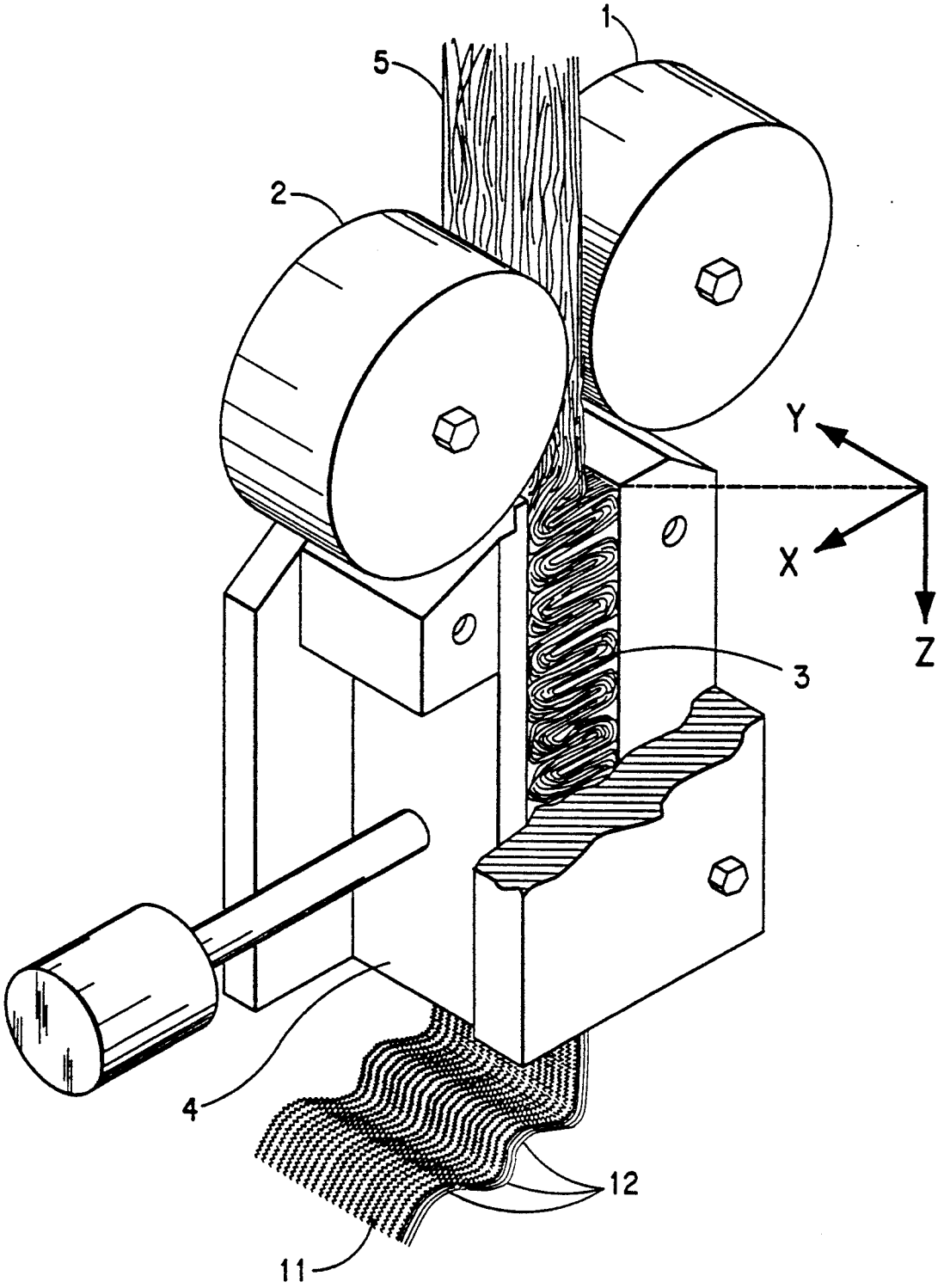
FIG. 6 is a perspective view, partly cut away, of a stuffer box-type crimper to show the crimping effects obtained.

In order to process regular synthetic staple fibers, their precursor filaments are generally treated in the form of a filamentary tow to mechanically deform the individual filaments and then set this deformation into their thermoplastic structure by heating under minimal tension. The main reasons for this are to provide fiber-fiber cohesion (to provide continuity and facilitate further textile processing steps for the cut fibers on cards and spinning frames) or to provide increased bulk and desirable tactile aesthetics. This process is commonly called crimping, and will be discussed in relation to FIG. 6, which shows a stuffer box-type of crimper.

Commercial crimpers vary in details (and the precise practice in any commercial operation may not have been known publicly) but they are generally composed of at least the following elements; feed rolls 1 and 2 to feed fibers into a stuffing chamber 3 where the fiber deformation takes place, and some means of applying back pressure, for instance by a pressure loaded gate 4 (or a second set of rolls) at the exit. There are many other parts but these are the keys to the ensuing discussion.

Ordinarily, a large number of filaments is formed into a tow band 5 of a width that is slightly less than the width of the stuffing chamber 3, and fed precisely into the stuffing chamber 3. This stuffing chamber can be thought of as a 3-dimensional box; it has a length, which can be thought of as in-line with the fiber flow through the process (we show this as a z-dimension), a width, which is slightly larger than the tow band width (we show this as a y-dimension), and a depth, which is the other dimension of the stuffing chamber 3 (we show this as an x-dimension). This stuffing chamber provides a transient capacitance or storage capability for the tow band and, coupled with the means for back pressure, causes the filaments to buckle in the y-z plane of the stuffing chamber because there is extra room for the filaments to so buckle in the y-dimension. Desirably, the type of crimp generated is called sawtooth or herringbone. If desired, the crimper can be heated, especially at the entrance, to facilitate crimping, and then cooled further on to help set the crimp, somewhat, before leaving the crimper. If the depth (x) of the stuffing chamber 3 is large enough and/or the amount of fiber fed into the stuffing chamber is low enough, the tow band will buckle in the x-z plane forming a more sinusoidal geometry. This crimp is usually of much larger amplitude and lower frequency than that generated by buckling in the y-z plane. For purposes of understanding the present invention, we refer to primary crimp as crimp such as is generated in the y-z plane, and to secondary crimp as crimp such as is generated in the x-z plane. These crimps are indicated in the tow band emerging from the crimper at the bottom of FIG. 6, with the secondary crimp indicated at 12 and the primary crimp at 11.

Figure 3:
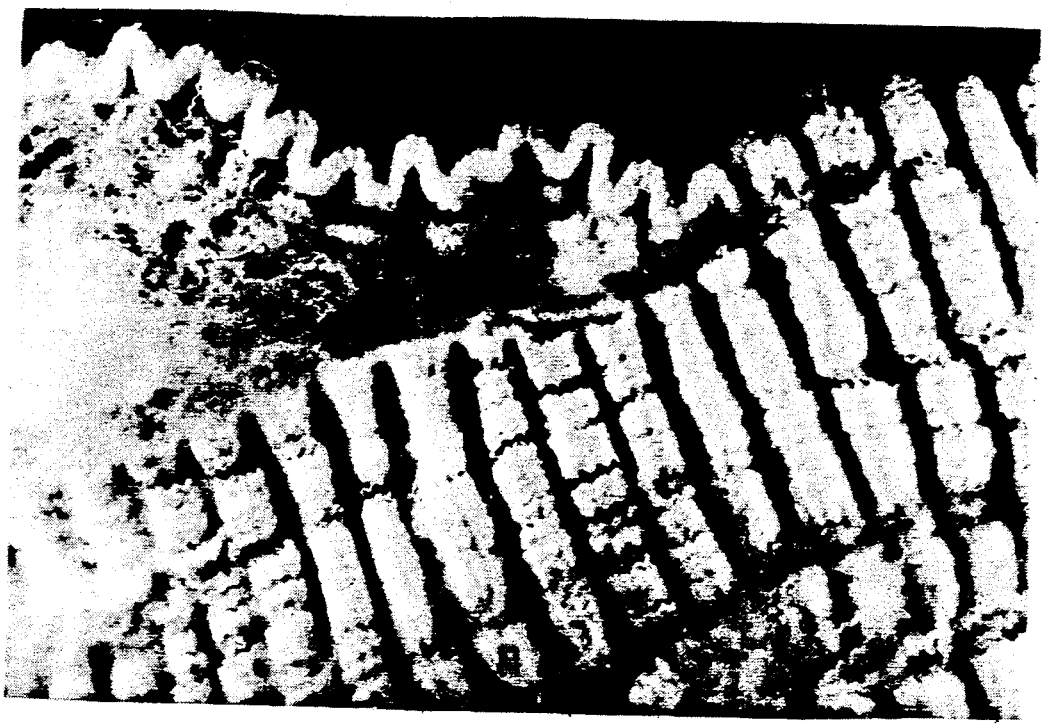
Figure 4:
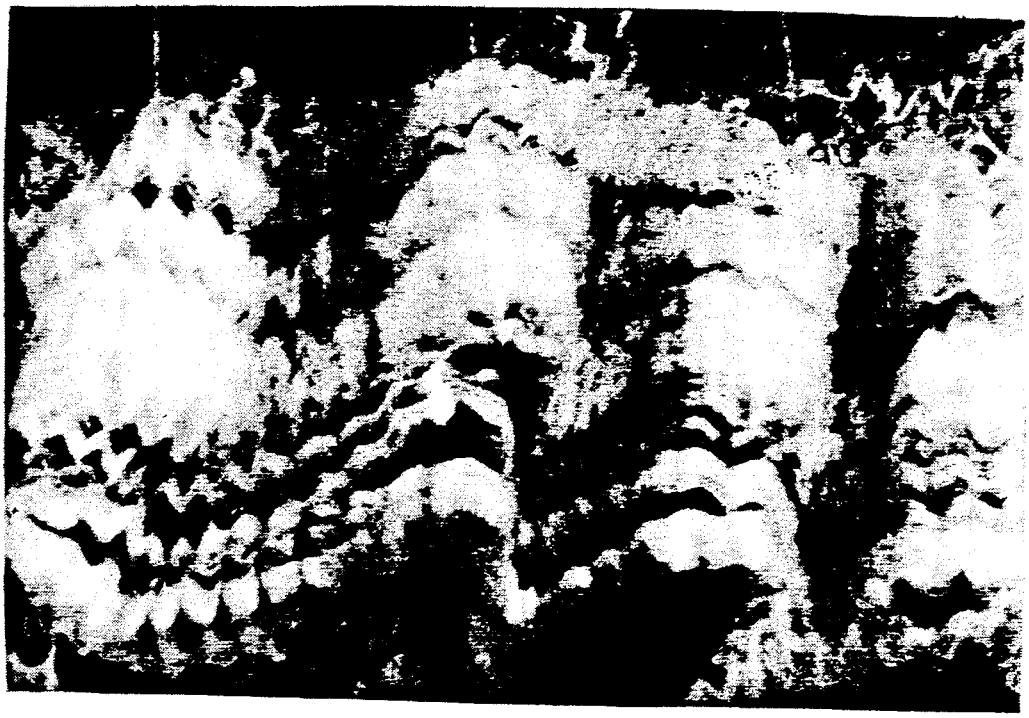
Figure 5:
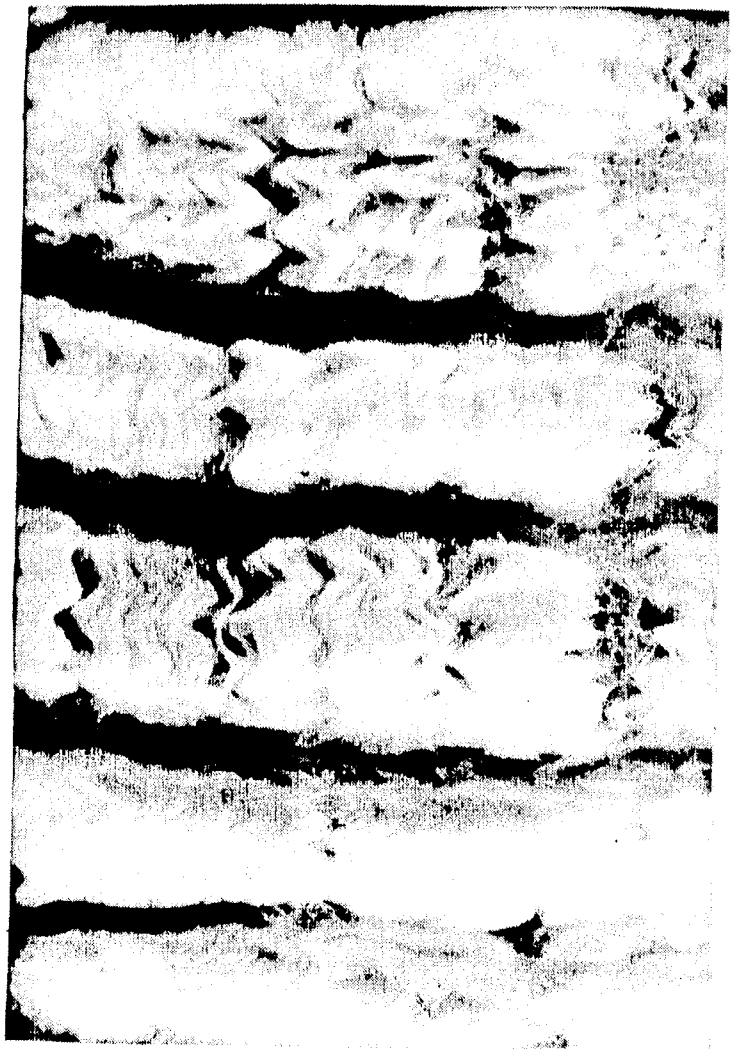

Both types of crimp can be seen in the photographs of a crimped tow band in FIGS. 3, 4 and 5. As can be seen from the lines on the backing paper (1 cm apart), FIGS. 4 and 5 are at a greater magnification than FIG. 3. The secondary crimp of the whole tow band is shown more evidently than the primary crimp, and is shown as approximately vertical rows with an amplitude generally perpendicular to the plane of the photograph, except that a portion of the tow at the top of FIG. 3 has been turned to show the amplitude in the plane of the photograph. This secondary crimp corresponds to the depth (in the x-dimension) of the stuffing chamber. FIG. 3 (corresponding to Example 1, hereinafter) shows a secondary crimp that is much better set than in FIG. 4 (corresponding to Comparison A). In FIG. 5, the heat-setting was intermediate, being better than FIG. 4, but not as good as FIG. 3. The primary crimp can be discerned in the photographs where some filaments have been pulled apart, and is of much smaller amplitude than the secondary crimp, and in a direction generally at right angles to that of the secondary crimp, as the primary crimp corresponds to the difference between the widths of the tow band and of the stuffing chamber (in the y-dimension of the stuffing chamber).

As noted herein, crimper loading can be an important factor in obtaining the crimp configuration desired for making fiberballs. Crimper loadings indicate the amount of filamentary tow (sometimes referred to as a rope) that is fed into the crimper, and is herein determined in terms of ktex per inch of crimper width.

An important requirement is that the secondary crimp be set in the filaments before it is pulled out, for instance as the tow is advanced from the crimper or during further processing of the tow. Depending on what has been used previously in any particular commercial practice, addition of some post-crimper means for avoiding tension before the crimp is well set and/or extra heat setting may be desirable, as prior practices have varied, and may not have been publicly known. It is the crimp configuration of the feed fiber at the time of fiberball formation that is important, rather than any transient crimp configuration within the crimper, or even shortly thereafter.

It will also be understood that, now we have explained the importance of a 3-dimensional heat set configuration in a feed fiber for making rounded fiber clusters (or fiberballs), such configurations may be obtained by other means within the broad ambit of the present invention. For ease of understanding, we have explained this in terms of a mechanical crimping process of the stuffer box-type.

A preferred mechanical crimping process to produce the feed fibers for making fiberballs essentially comprises crimping the rope under a relatively low crimper loading. We have used successfully such loadings as 13 to 26 ktex per inch (crimper width) for round filaments of 4 to 10 dtex, and somewhat higher loadings, up to 34 ktex per inch, for higher deniers. As will be understood, any precise crimper loadings will depend on various considerations apart from the denier of the fibers, including the technique and conditions that will be used to convert the feed fiber into fiber clusters. We have found that a card-type technique is more forgiving than when a modified Lorch-type equipment is used. A low crimper loading helps to generate the secondary crimp, and affects its frequency and amplitude, and to some extent improves the heat-setting of the secondary crimp, which constitutes the memory of the fiber to spontaneously curl. A low crimper load leaves more space for the rope to fold back and forth, and may cause rotation of the tow band, which can create variations in the crimping plane of the secondary crimp, which all help to produce a good three dimensional fiberball structure, as disclosed hereinafter. Secondary crimp is essential for the production of the fiberballs according to the invention, but to produce optimal results it has to be heat-set as well as possible to fix the desired crimp configuration.

As indicated, U.S. Pat. Nos. 4,618,531 and 4,783,364 disclosed fiberballs produced from feed fibers having a spiral (or helical) crimp. Such fiberballs have relatively few fibers sticking out of the fiberball and, as a result, a low cohesion between the fiberballs. The spiral crimp also provides optimal contribution of the fibers to the bulk, resilience and durability of the fiberfill, as well as the refluffability. The fiberball structure depends in great part on the spontaneous curling of the fibers due to the "memory" of the fibers, which results from their bicomponent structure or from spin stresses imparted during asymmetric quenching. The spontaneous curling potential allows fiberballs to be produced from the feed fibers under very mild conditions, applying very low forces to achieve a consolidated fiberball structure. The fiberballs have a resilient structure with excellent filling power and durability.

The main difference between such fiberballs and prior products referred to as "nubs", or similar commercial products, produced usually on cards, is that the "nubs" contain a very substantial amount of fibers that are present in a strongly entangled nucleus and do not contribute any resilience, but constitute simply a "dead weight". These nubs can be sufficiently strongly entangled so that they can resist a carding operation. Nubs are well adapted for incorporation into slub yarns (for example for berber carpets, tapestries and other textile uses requiring different visual and tactile aesthetics), but do not have the bulk, resilience and durability required for filling applications.

As indicated, Marcus produced his resilient fiberballs by using helically crimped fibers, and his air tumbling process fiber did not produce fiberballs from standard mechanically-crimped fibers. Helically crimped fibers remain a preferred feed for producing such products with the desired structure, but we have now discovered that, contrary to previous experience, fiberballs with a very similar structure can be produced from modified mechanically crimped fibers having a very specific combination of primary and secondary crimp. The key is believed to be in providing the feed fibers with a potential to spontaneously curl. Although this may not always be as strong as with bicomponent fibers, this potential to curl allows fiberballs to be produced under mild conditions, resulting in a similar structure. The crimp configuration of the fiber and the process conditions used to produce these fibers are important in regard to fiberball structure. Air tumbling conditions which did not produce any fiberballs with standard commercially available mechanically crimped fibers, may be used according to the present invention to produce a product with acceptable structure, filling power and durability from fibers with a modified mechanical crimp. The key parameter in the making of fiberballs with the optimal structure from these modified "mechanically crimped fibers" is the secondary crimp. It is the secondary crimp of these fibers which is believed to impart their potential to spontaneously curl, because it provides three-dimensional crimp configurations.

Thus the key element in the production of fibers having modified mechanical crimp (such as is required for the formation of the fiberballs according to the invention) is believed to be a well set secondary crimp with a frequency of from about 4 crimps/10 cm to about 16 crimps/10 cm. The primary crimp is believed to be less critical. It is preferable to have a primary crimp which is below 28 crimps/10 cm, because it helps to better set the primary crimp and makes the rolling and fiber entangling in the fiberball easier; but some good results are achieved with a primary crimp frequency as high as about 40 crimps/10 cm (Example 1). A simple and proven way that we have used to achieve a pronounced secondary crimp that is well set is to reduce the crimper load, but this may also be achieved by other means e.g. widening the crimper throat, i.e. the x-dimension.

The polyester rope which is used for the process is preferably laid down into the crimper at a relatively low crimper load or density, preferably below 26 ktex per inch, to allow it to fold back and forth changing direction at a rate of about 8 to about 32 times within a section of 10 cm length of rope. Preferably, because of this low crimper loading, the tow band should not only be folding back and forth, but also changing the angle of the laydown, so as to create changes in the plane of the secondary crimp, so the secondary crimp is not necessarily always at right angles to the plane of the primary crimp. Secondary crimp, its frequency, its three-dimensional character, and heat setting of its configuration are keys to whether mechanically crimped fiber will form fiberballs, and to their structure. We believe, based on some observations during production, that in most cases the secondary crimp node serves as a reversal point for the fiber to go from one side to the other of the fiberball, creating round smooth loops on the surface of the fiberball. The resulting structure is very similar to the structure of fiberballs produced from helical crimp feed fibers. The indicated frequency and amplitude of the secondary crimp are not sufficient unless they have been well set in this configuration. This can be easily estimated functionally by stretching a bundle and releasing it, to evaluate the crimp take up. Such a functional evaluation could be developed into a quantitative measurement, if desired, as indicated hereinafter, or, for instance by (1) mounting a bundle of known ktex in an Instron machine, extending to remove secondary crimp, and then measuring the crimp recovery force from Instron load cell response, or (2) by fixing one end of a bundle of known ktex, stretching it under some extension means to achieve and measure its fully extended length (TL), then removing the extension means so as to allow the bundle to retract and measuring the retracted length (RL), and calculating the CTU as the percentage difference between the two lengths measured (TL-RL) as a percentage of the fully extended length (TL). But we have used the functional assessment and have found it satisfactory for guiding the development of new products based on the present invention.

Primary crimp also plays a certain minor role in fiberball formation and structure. It is preferable to have a relatively low frequency of below 28 crimps/10 cm and rounded crimp nodes, but these by themselves are not sufficient to achieve the desired fiberball structure without the secondary crimp. It has been demonstrated that merely providing low levels of primary crimp has not been sufficient to form fiberballs on the modified Lorch equipment mentioned previously.

We have found that feed fibers with a solid cross-section generally form fiberballs more easily than hollow fibers, particularly on the modified Lorch type equipment disclosed in U.S. Pat. Nos. 4,618,531, 4,783,364, and 4,794,038. On certain modified cards, differences due to the secondary crimp may be smaller, as regards an ability merely to make clusters. But the specific crimp as disclosed in the invention remains important for the production of fiberballs with desirably good structure, durability, filling power (loft/bulk), and low cohesion. Although solid fibers and relatively low deniers are generally more easily rolled into fiberballs according to the invention, the invention can produce fiberballs from fibers with a high bending modulus such as 13 dtex, 4-hole, 25% void fibers, as can be seen from the Examples. It is believed that the technology used with prior art (modified) cards did not allow fiberballs to be produced with high bulk and good durability from such high bending modulus fibers, or multiple channel fibers. The present invention is believed to be the best and perhaps only practical route to produce fiberballs with the desired structure from high void and/or multichannel fibers. These are very difficult to produce with a helical crimp, via jet quenching. The bicomponent route would be extremely difficult; to our knowledge, such bicomponent fibers have not been commercially produced. The combination of primary and secondary crimp of the invention allows the manufacturing of fiberballs from such feed fibers without difficulty, producing a good and performing filling product for end-uses requiring high filling power, high support, and good durability.

The polyester fibers used for the manufacturing of the fiberballs of the invention can be coated with a slickener and any conventional slickening agent can be used for this purpose. Such materials are described in U.S. Pat. No. 4,794,038. Conventional slickeners are normally used at a level between 0.01 and about 1% Si on the weight of the fiberball. Silicone polymers are used generally at concentrations in amounts (approximately) of 0.03% to 0.8%, preferably 0.15 to 0.3%, measured as % Si on the weight of the fiber. The slickener's role here is to reduce the cohesion between the filaments and allow the formation of a better structure during the fiberball making operation, to improve the slickness of the filling material, and to reduce the cohesion between the fiberballs (improving refluffability). As disclosed, however, the feed fibers can be coated with about 0.05% to about 1.2% by weight (of fiber) of a segmented co(polyalkylene oxide/polyethylene terephthalate), such as those disclosed in U.S. Pat. Nos. 3,416,952, 3,557,039, and 3,619,269 to McIntyre et al., and various other patent specifications disclosing like segmented copolymers containing polyethylene terephthalate segments and polyalkylene oxide segments. Other suitable materials containing grafted polyalkyleneoxide/polyethylene oxide can be used. The fiber/fiber friction achieved with these products is very similar to those achieved with silicones, but the fibers slickened with these materials do bond to commercial copolyester binder fibers and this is essential for the manufacturing of fiberballs for molding purposes, as disclosed in I. Marcus' copending U.S. application Ser. No. 07/549,847 (DP-4391) and in U.S. Pat. No. 4,940,502.

Due to the high resilience and support of the cushions made by molding of the fiberballs, which is about the same for a 25 kg/m3 fiberball block and for a 45 kg/m3 block batt made from the same fiber blend, an amount of 5 to 30%, preferably 10 to 20%, by weight of binder fiber is required. Suitable binder fibers, that can be used are described, e.g. by Marcus in U.S. Pat. Nos. 4,794,038 and 4,818,599, which are hereby specifically incorporated by reference, as is Kerawallas U.S. Pat. No. 5,164,969, relating to bonded fibrous structures using microwaves as a high frequency energy source, and preferably using binder fibers that contain an electromagnetic radiation (EMR) susceptor.

The invention is further described in the following Examples in which the fibers were all made from polyethylene terephthalate. All parts and percentages are by weight, and are based on the weight of the fibers, unless otherwise stated. The bulk measurements were made on 80×80 cm pillows (1000 g filling weight), and the bulk losses are given as a % after simulated wear testing. The qualitative assessment of the structures reflects the proportion of the fiberballs that were round, the hairiness (loose structure, well entangled etc.) on a scale of 1=(worst) to 5=(best).

Comparison A

A drawn and crimped rope was prepared conventionally from 6.7 dtex solid fiber, using a draw ratio of 3.5X, a crimper loading of 29 ktex per inch, and 0.25% (Si) of a commercial polysiloxane slickener. The resulting fiber had a primary crimp frequency of 31 crimps/10 cm with 3 poorly set secondary crimps/10 cm. The rope was cut to 32 mm cut length staple and the staple was opened on a commercial Laroche opening unit and injected into a modified Lorch machine, as disclosed in U.S. Pat. Nos. 4,618,531; 4,783,364; and 4,794,038. The fibers were tumbled in the machine for 4 minutes at 450 rpm. No fiberballs were formed from this feed fiber under these conditions.

EXAMPLE 1

This was similar to Comparison A, but the rope was crimped under reduced pressure and the crimper load was reduced by 38.5%. The resulting product had a primary crimp frequency of 39 crimps/10 cm and a relatively strong secondary crimp with a frequency of 4 crimps/10 cm which was much better set, as shown by the crimp pull out force, which was about 0.6N/ktex (about 4 times that of the secondary crimp of the feed fiber used in Comparison A). The rope was cut into 32 mm cut length staple which converted easily into fiberballs, under the conditions described above, with a good structure and refluffability. Table 1B gives the properties of these balls from Example 1, and compares them with a commercial product made from spiral-crimp 5 dtex (silicone-slickened) feed fiber according to U.S. Pat. No. 4,618,531.

TABLE 1A

| | Crimp Characteristics | |
|---|---|---|
| | Comparison A | Example 1 |
| Crimps/10 cm primary crimp | 31 | 39 |
| Crimps/10 cm secondary crimp | 3 | 4 |
| Crimp pull-out force (N/ktex) | | |
| Primary crimp | 6.0 | 5.3 |
| Secondary crimp | 0.14 | 0.57 |

Conclusions from comparisons summarized in Table 1A.

To produce fiberballs with an acceptable structure by this technique, a significant frequency of secondary crimp that is well heat-set is required. Although the forces required to pull out the primary crimps were comparable for the feed fibers of Comparison A and Example 1, the force required to pull out the secondary crimp was 4 times higher in the case of Example 1. This force corresponds directly to the heat-setting of the secondary crimp, which is related to the potential of the fiber to spontaneously curl.

As Comparison A did not form fiberballs under the test conditions, the fiberballs of Example 1 were compared with commercial fiberballs.

TANLE 1B

| | Fiberball properties | |
|---|---|---|
| | Commercial | Example 1 |
| 1. Bulk | | |
| IH2 | 228 mm | 212 mm |
| 4N | 208 mm | 190 mm |
| 60N | 101 mm | 87 mm |
| 200N | 44 mm | 39 mm |
| 2. Bulk losses | | |
| IH2 | −25.2% | −21.2% |
| 4N | −25.0% | −20.7% |
| 60N | −21.2% | −16.4% |
| 200N | −5.7% | −2.6% |
| 3. Cohesion and rating | | |
| Cohesion | 3.3N | 4.3N |
| Qualitative rating | 4–5 | 4 |

Conclusions from comparisons summarized in Table 1B.

These mechanically crimped fibers produced fiberballs with filling power and durability that were comparable to those of commercial fiberballs produced from spiral crimp fibers.

Figure 1A:
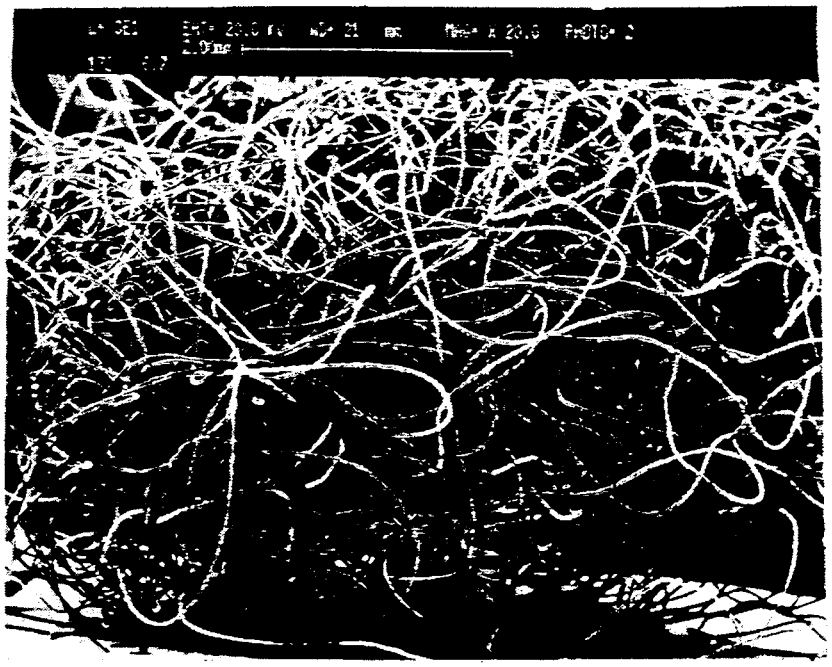
Figure 1B:
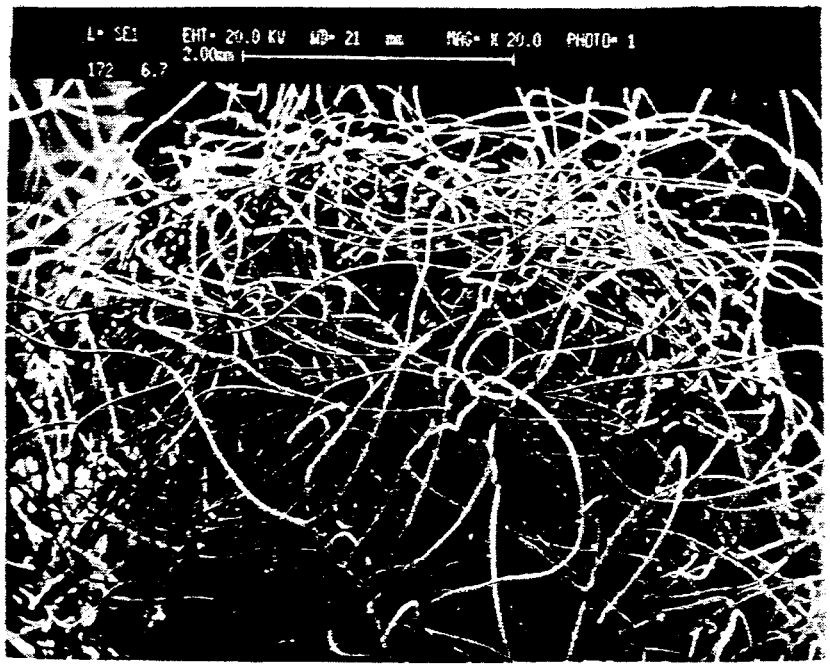

FIGS. 2A and 2B are photographs taken, through an Electron Scanning Microscope (ESM) at a magnification of 20X, of the commercial fiberballs (made from 5 dtex spiral crimp fiber). FIGS. 1A and 1B are similar photographs of the fiberballs of Example 1. This ESM photographic comparison shows very similar random arrangements of the fibers within the fiberballs and similar uniform fiber densities. The fibers in both products had fully developed their bulk with no felting. This structure determines the performance of the fiberball products; bulk, durability and refluffability. The similarities of structure shown in the photographs explain the similarities of data in Table 1B.

FIGS. 3 and 4 are photographs of tow bands from which were cut feed fibers used as described above. FIG. 3 corresponds to Example 1, whereas FIG. 4 corresponds to Comparison A. These clearly show the secondary crimp as rows going from bottom to top of the photographs. The primary crimp is seen in the cracks formed on the top of these rows by the manipulations made to separate the individual fibers from the rest of the rope. A bundle of fibers which was separated from the rope and turned 90 degrees can be seen at the upper part of FIG. 3. The configurations of the secondary and primary crimps can be observed. The small amplitude, and high frequency of primary crimp versus the high amplitude and low frequency of the secondary crimp can be clearly seen. The difference between the secondary crimps in FIGS. 3 and 4 are evident from these photographs. FIG. 5 shows a tow band of 6.1 dtex single hole fiber which produced fiberballs on the modified Lorch machine, but with rather a poor structure. The secondary crimp is seen to be far better than for Comparison A (FIG. 4), but was not adequately heat set. This could be adjusted, so an improved feed fiber would be obtained.

COMPARISON B

A drawn and crimped rope was prepared conventionally from 13 dtex, 4-hole, 24% void fiber, using a draw ratio of 3.5X, a crimper load of 26 ktex per inch, and 0.5% of a commercial co-polyether/polyester ZELCON* 5126, available from E. I. du Pont de Nemours and Company. The resulting fiber had a primary crimp frequency of 22 crimps/10 cm with a poorly set secondary crimp frequency of 2 crimps/10 cm. The rope was cut to 50 mm cut length staple, and the staple was opened on a carding machine and then conveyed by air to a roller card, modified to produce fiberballs of average diameter about 6.5 mm. The fiberballs were produced at 80 kg/hour and showed substantial hairiness and a relatively high cohesion of 10.5N, with a few elongated bodies. The fiberballs had non-uniform density with some sections having a high density and showing some limited felting. This felting reduces the bulk (i.e., the filling power) and, to a lesser extent, the resilience of the product (Table 2). The staple fiber did not produce any fiberballs on the modified Lorch machine under the conditions used for Example 1.

EXAMPLE 2

A drawn and crimped rope was prepared as in Comparison B, but the crimper gate pressure was reduced to increase the secondary crimp and improve its heat-setting, using the same draw ratio 3.5X, crimp load (26 ktex per inch), and 0.5% of a commercial co-polyether/polyester ZELCON* 5126, available from E.I. du Pont de Nemours and Company. The resulting fiber had a primary crimp frequency of 22 crimps/10 cm with a secondary crimp frequency of about 4 crimps/10 cm. The secondary crimp was well pronounced, but its heat-setting did not seem to be optimal as judged by a subjective rating of the recovery force of the stretched rope. The rope was cut to 50 mm cut length staple and the staple was opened on a carding machine, then conveyed by air to a roller card, modified to produce fiberballs. The fiberballs were produced at 95 kg/hour, under the same settings as for Comparison B, and showed low hairiness and well formed fiberballs, having an average diameter of 6.3 mm with a very significant reduction in the felted area. As a result, the cohesion dropped to about 6.5N and the bulk (filling power) also showed a significant improvement (Table 2 ). This fiber did form fiberballs on the modified Lorch equipment under the conditions used for Comparison A and Example 1, but their structure was poorer than the commercial products made on the same equipment, from spiral crimp feed fibers. The reason is believed to be that the heat setting of the secondary crimp in this test item was not adequate; this air-tumbling process requires a feed fiber with stronger potential for spontaneous curling than does the modified card.

TABLE 2

| | Comparison B | Example 2 |
|---|---|---|
| Crimp characteristics | | |
| Crimps/10 cm primary crimp | 22 | 22 |
| Crimps/10 cm secondary crimp | 2 | 4 |
| Fiberball properties | | |
| IH2 | 90 mm | 125 mm |
| 7.5N | 67 mm | 88 mm |
| 60N | 41 mm | 48 mm |
| 120N | 33 mm | 37 |
| mmWork Recovery | 48.5% | 55% |
| Cohesion | 10.5N | 6.5N |

(Note - although the secondary crimp for Example 2 was better set than for Comparison B, it did not have a high recovery force, judged subjectively)

Conclusions from comparisons summarized in Table 2.

The product of Example 2 showed a much higher filling power with 39% higher initial height and 17% higher support bulk versus Comparison B. The cohesion was significantly lower, reflecting much better refluffability. The product of Example 2 has a high commercial value, while Comparison B is judged unsatisfactory.

Comparison C

A drawn and crimped rope was prepared as in Comparison B. This rope was cut to 50 mm together with a bicomponent 17 dtex sheath/core binder in a weight ratio of 88:22 and the staple was opened on a carding machine, then conveyed by air to a roller card, modified to produce fiberballs of average diameter about 6.5 mm. The fiberballs were produced at 74 kg/hour and showed substantial hairiness and relatively high cohesion of 12N, with a few elongated bodies. The fiberballs had non-uniform density with some sections having a high density and showing some limited felting. This felting reduced the bulk (i.e. the filling power) and, to a lesser extent, the resilience of the product (Table 3).

EXAMPLE 3

A 13 dtex, 4-hole, 24% void, drawn and crimped rope was prepared as for Example 2. This rope was cut to 50 mm cut length staple together with a 17 dtex bicomponent sheath/core fiber rope at a weight ratio of 88:22 and the staple was opened on a carding machine, then conveyed by air to a roller card, modified to produce fiberballs. The fiberballs were produced at 87 kg/hour, under the same settings as for Comparison C, and showed low hairiness and well formed fiberballs, having an average diameter of 6.5 mm with a very significant reduction in the felted area. As a result the cohesion dropped to about 7.5N and the bulk (filling power) improved significantly over Comparison C, as can be seen in Table 3.

TABLE 3

| | Comparison C | Example 3 |
|---|---|---|
| IH2 | 93 mm | 136 mm |
| 7.5N | 68 mm | 92 mm |
| 60N | 41 mm | 48 mm |
| 120N | 33 mm | 36 mm |
| Work Recovery | 48.6% | 55% |
| Cohesion | 12.0N | 7.5N |

DESCRIPTION OF TEST METHODS USED

Many of the tests used herein have been described already in the prior parents referred to herein.

Bulk Measurements on Cushions

Bulk measurements are made conventionally on an Instron machine to measure the compression forces and the height of the cushion. The measurement is made with a foot of diameter 10 cm attached to the Instron. The sample is first compressed to the maximum pressure of 60N once, then released. From the second compression curve are noted the Initial Height (IH2) of the test material, the support bulk (SB 7.5N), i.e., the height of the cushion under a force of 7.5N, and the height under a force of 60N (B60N). The softness is calculated both in absolute terms (AS, i.e. IH2-SB 7.5N) and in relative terms (RS, i.e., As expressed as % of IH2). Resilience is measured as Work Recovery (WR%), i.e., the ratio of the area under the whole recovery curve, calculated as a percentage of that under the whole compression curve. Durability:

To simulate prolonged normal use, a Fatigue Tester (FTP) has been designed to alternately mechanically work (i.e. compress and release) a pillow through about 6,000 cycles over a period of about 18 hours, using a series of overlapping shearing movements followed by fast compressions designed to produce the lumping, matting and fiber interlocking that normally occur during prolonged use with fiberfill. The amount of fiberfill in the pillow can greatly affect the results, so each pillow (80×80 cm) is blow-filled with 1000 g of filling material, unless otherwise stated.

It is important that pillow should retain its ability to recover its original shape and volume (height) during normal use, otherwise the pillow will lose its visual aesthetics and comfort. So bulk losses are measured, in a conventional manner, on the pillows both before and after exposure to the Fatigue Tester, mentioned above. Visual aesthetics, bulk and softness of a pillow are a matter of personal and/or traditional preferences, what is important is that the change of the properties of the pillow during wear will be as small as possible (i.e., the durability of the pillow). Bulk measurements are made on an "Instron" machine to measure the compression forces and the height of the pillow, which is compressed with a foot of diameter 288 mm attached to the Instron. From the Instron plot are noted (in cm) the Initial Height (IH2) of the test material, the Support Bulk (the height under a compression of 60N) and the height under a compression of 200N. The softness is considered both in absolute terms (IH2-Support bulk), and in relative terms (as a percentage of IH2). Both are important, and whether these values are retained after stomping on the Fatigue Tester.

Cohesion Measurement

This test was designed to test the ability of the fiberfill to allow a body to pass therethrough, and this correlates with refluffability in the case of fiberballs made from fibers having comparable properties such as denier, slickener, etc. In essence, the cohesion is the force needed to pull a vertical rectangle of metal rods up through the fiberfill which is retained by 6 stationary metal rods closely spaced in pairs on either side of the plane of the rectangle. All the metal rods are of 4 mm diameter, and of stainless steel. The rectangle is made of rods of length 30 mm (vertical) and 160 mm (horizontal). The rectangle is attached to an Instron and the lowest rod of the rectangle is suspended about 3 mm above the bottom of a plastic transparent cylinder of diameter 180 mm. (The stationary rods will later be introduced through holes in the wall of the cylinder and positioned 20 mm apart in pairs on either side of the rectangle). Before inserting these rods, however, 50 g of the fiberfill is placed in the cylinder, and the zero line of the Instron is adjusted to compensate for the weight of the rectangle and of the fiberfill. The fiberfill is compressed under a weight of 402 g for 2 minutes. The 6 (stationary) rods are then introduced horizontally in pairs, as mentioned, 3 rods on either side of the rectangle one pair above the other, at vertical separations of 20 mm with the lowest pair located at 30 mm from the bottom of the cylinder. The weight is then removed. Finally, the rectangle is pulled up through the fiberball between the three pairs of stationary rods, as the Instron measures the build-up of the force in Newtons.

% Round

As indicated, tails, i.e., condensed cylinders of fiberfill, are not desirable since they decrease the refluffability (and increase the cohesion value) of what would otherwise be fiberballs of the invention, so the following method has been devised to determine the proportions of round and elongated bodies. About 1 g (a handful) of the fiberfill is extracted for visual examination and separated into three piles, those obviously round, those obviously elongated, and those borderline cases which are measured individually. All those having a length to width ratio in cross-section of less than 2:1 are counted as round.

The dimensions of the fiberballs and denier of the fibers are important for aesthetic reasons, but it will be understood that aesthetic preferences can and do change in the course of time. The cut lengths are preferred for making the desired fiberballs of low hairiness. As has been suggested in the art, a mixture of fiber deniers may be desired for aesthetic reasons.

Determination of Crimp Frequency

The crimp frequencies are determined using a Crimp Balance Zweigle S-160 from Zweigle Reutlingen (Germany).

Determination of Primary Crimp Frequency

The number of primary crimps is counted while the specimen is under a low tension. Thus, the individual fibers are fixed on the Crimp Balance and a weight of 2 mg/dtex is placed on the hook and the primary crimps are counted. (The measured length may be recorded as L1.) The frequency is calculated based on the specimen's extended length L2 under high tension. This extended length L2 is determined under a weight of 45 mg/dtex. The crimp frequency is then calculated with regard to L2.

Determination of Secondary Crimp Frequency

The extended length L2 is determined as above and the specimen is then relaxed completely to 60% of its extended length. The secondary crimp is then counted and its frequency calculated with regard to the extended length L2 under 45 mg/dtex.

Measurement of the Uncrimping Stress of the Secondary Crimp

The heat-setting of the secondary crimp helps establish the memory of the fibers to spontaneously curl. The measurement of the force required to uncrimp the secondary crimp is directly related to the fibers potential to spontaneously curl. Weak forces show poor heat-setting. This may result in poor fiberball structure even when the frequency and amplitude of the secondary crimp are otherwise adequate.

A bundle of fibers, cut from a rope of about 0.7 ktex is fixed with clamps on the Instron and the bundle elongated at a constant rate of extension until the resulting curve becomes a straight line. The bundle is marked at the clamps level and removed from the Instron. The bundle is weighed to calculate its exact ktex and a weight of 2 mg/dtex is suspended to determine its length between the two marks (i.e. the uncrimping strain for the secondary crimp). This length is recorded on the stress strain curve, so as to determine the uncrimping stress for the secondary crimp. The uncrimping stress for the primary crimp can be calculated by continuing the straight line portion of the stress strain curve until it intersects with the base line. From the intersection point a perpendicular is drawn up until it intersects the stress strain curve. The stress read at this intersection point corresponds to the total uncrimping force of the bundle, from which the uncrimping force of the primary crimp is calculated by the difference between the total force and the force to uncrimp the secondary crimp. The force required to uncrimp the primary crimp is generally an order of magnitude higher than the force required to uncrimp the secondary crimp.

As will readily be understood, the present invention is particularly useful as applied to fiberfill, for filling applications, and to polyester fibers having characteristics suitable for such purposes, but the invention is not restricted thereto. As can be understood from copending application Ser. No. 07/508,878 (DP-4690), fiber clusters may also be made from other fibers, and need not be restricted to the deniers useful and suitable for filling purposes. Also, other variations will be evident to those skilled in the art. For instance, fiber clusters may be made from blends of different materials, to gain advantages and enhanced properties. Especially advantageous results may be obtained by combining in the same cluster structure different fiber configurations, as regards to crimp, and/or denier, and/or fiber structure, to maximize the individual contributions in the whole cluster. Furthermore, different types of crimp may be combined in the same fiber with advantage, to give an enhanced cluster making potential, and/or improved properties in the resulting cluster. Also, as indicated, those skilled in the art can devise many ways of generating a three-dimensional loopy structure in a filament without using a stuffer box crimper, so that such loopy filaments are suitable for (cutting into staple and) forming into clusters on appropriate machines such as modified Lorch equipment or modified cards. Such alternative crimping means may include stuffer jet crimping, false twist texturing and air jet texturing, by way of example. The invention is not restricted only to the process or apparatus embodiments set out specifically herein.

We claim:

1. A process for preparing fiberballs, wherein mechanically-crimped staple fiber of length about 10 to about 100 mm is prepared having a primary and a secondary crimp, said primary crimp having a frequency of about 14 to about 40 crimps/10 cm and said secondary crimp having a frequency of about 4 to about 16 crimps/10 cm, and whereby the average ampitude of the secondary crimp is at least 4 times the average amplitude of the primary crimp, and wherein tufts of said mechanically-crimped staple fiber are processed by air-tumbling against the wall of a vessel to make fiberballs having a random distribution and entanglement of fibers within each ball and of average diameter about 2 to about 20 mm.

2. A process according to any one of claim 1, wherein polyester staple fibers are processed into fiberballs.

3. A process according to claim 1, wherein staple fiber is processed into fiberballs of roundness such that at least 50% by weight of the balls have a cross section such that the maximum dimension of each ball is not more than twice the minimum dimension.

4. A process according to claim 1, wherein the fibers are coated with about 0.05% to about 1.2% (by weight of the fibers) of a slickener which consists essentially of a segmented copolymer of poly(alkyleneoxide).

5. A process according to claim 1, wherein the fibers are coated with a slickener, which is a silicone polymer, in amount about 0.01% to about 1% Si (by weight of the fibers).

6. A process according to claim 1, wherein a blend of said staple fibers with binder fibers is processed to make fiberballs.

7. A process according to claim 6, wherein the binder fibers are polymeric bicomponent sheath/core or polymeric bicomponent side-by-side fibers, consisting essentially of a component polymer with a bonding temperature that is at least 50° C. below the melting temperature of another component polymer.

8. A process according to claim 6, wherein said binder fibers contain an electromagnetic radiation susceptor.

9. A process according to claim 6, wherein the binder in said binder fibers is activated so as to bond said staple fibers and form a bonded structure, in which said staple fibers become load-bearing fibers.

10. A process according to claim 7, wherein the binder in said binder fibers is activated so as to bond said staple fibers and form a bonded structure, in which said staple fibers become load-bearing fibers.

* * * * *